US007065855B2

(12) United States Patent
Janusz

(10) Patent No.: US 7,065,855 B2
(45) Date of Patent: Jun. 27, 2006

(54) INSTALLATION TOOL FOR SETTING ANCHORS

(75) Inventor: Michael Janusz, Elgin, IL (US)

(73) Assignee: Textron Inc., Providence, RI (US)

( * ) Notice: Subject to any disclaimer, the term of this patent is extended or adjusted under 35 U.S.C. 154(b) by 448 days.

(21) Appl. No.: 10/374,592

(22) Filed: Feb. 25, 2003

(65) Prior Publication Data

US 2004/0163229 A1 Aug. 26, 2004

(51) Int. Cl.
*B21D 39/00* (2006.01)

(52) U.S. Cl. ..... 29/523; 29/522.1; 29/456; 29/256; 29/270; 411/75; 411/76; 411/44; 411/45; 411/55

(58) Field of Classification Search ..... 29/522.1, 29/523, 456, 256, 270, 280, 282; 411/44, 411/45, 55, 75, 76
See application file for complete search history.

(56) References Cited

U.S. PATENT DOCUMENTS 1,710,639 A * 4/1929 Hooley ..... 411/28
2,128,844 A * 8/1938 Myer et al. ..... 29/266
2,562,419 A * 7/1951 Ferris ..... 29/243.519
2,995,266 A * 8/1961 Crawford ..... 29/243.519
3,462,988 A * 8/1969 Tudor ..... 29/243.519
3,472,052 A * 10/1969 Chance ..... 29/243.519
3,587,271 A * 6/1971 Rigot ..... 72/114
3,600,789 A * 8/1971 Buberniak ..... 29/264
4,121,444 A * 10/1978 Duran ..... 72/114
4,400,960 A * 8/1983 Martin ..... 72/114
4,489,471 A * 12/1984 Gregory ..... 29/243.524
4,763,396 A * 8/1988 Fischer ..... 29/458
4,899,431 A * 2/1990 Borntrager ..... 29/244
5,050,286 A * 9/1991 Miyanaga ..... 29/275
5,050,420 A * 9/1991 Liu ..... 72/391.4
5,098,227 A * 3/1992 Wright ..... 405/259.6
6,048,149 A 4/2000 Garcia
6,840,075 B1 * 1/2005 Neri et al. ..... 72/114

OTHER PUBLICATIONS

Greenlee Product Catalog © 2000—3 pages.
HILTI Product Technical Guide, Sep. 1995—1 page.
Rawl Fastening Systems Design Manual © 1997—5 pages.

* cited by examiner

*Primary Examiner*—George Nguyen
*Assistant Examiner*—Christopher M. Koehler
(74) *Attorney, Agent, or Firm*—Trexler, Bushnell, Giangiorgi, Blackstone & Marr, Ltd.

(57) ABSTRACT

The invention provides an installation tool for use with a battery operated drill or a corded electric drill for repetitive installation of caulk-in anchors. The installation tool utilizes the mechanical advantage of a threaded shaft to improve consistency of the holding reliability of the caulk-in anchor and controls the anchor setting process to insure proper installation while reducing installation time. The installation tool does not rely on bottom setting or a hammer strike to set the anchor, but can be set at a depth independent of hole depth. In one embodiment, the tool can be used with a through hole in the substrate and uses a combination of a threaded shaft and a controlled sensing spring to insure a more uniform installation of the anchor within the substrate across the entire length of the sleeve portion of the anchor, along with a visual check of proper setting of the anchor.

27 Claims, 11 Drawing Sheets

INSTALLATION TOOL FOR SETTING ANCHORS

BACKGROUND OF THE INVENTION

The present invention relates to a tool used for the installation of caulk-in anchors.

Two prior art examples of tools used for the installation of caulk-in anchors are illustrated in FIGS. 1–4. A first prior art tool 20 is illustrated in FIGS. 1 and 2 for setting an anchor 22 within a hole 24 of a substrate 26. The anchor 22 has a hollow cone portion 28 which is positioned within a hollow sleeve portion 30. The cone portion 28 has an enlarged head portion 32 at one end thereof which is not positioned within the hollow sleeve portion 30. The anchor 22 is of a bottom-setting type such that the enlarged head portion 32 of the cone portion 28 of the anchor 22 is positioned against the base 34 of the hole 24 of the substrate 26 to prevent movement of the cone portion 28 of the anchor 22 upon setting of the anchor 22 within the hole 24.

The tool 20 has an enlarged diameter portion 36, which is slightly smaller than a diameter of the hole 24 of the substrate 26, and a stem 38 extending from one end of the enlarged diameter portion 36.

In operation, the tool 20 is inserted into the hole 24 of the substrate 26 such that the stem 38 fits into the opening of the cone portion 28 of the anchor 22, at the opposite end thereof from the enlarged head portion 32. The stem 38 does not engage the cone portion 28, but rather only acts as a guide. The enlarged diameter portion 36 of the tool 20 abuts against a first end 40 of the sleeve portion 30 of the anchor 22. The enlarged diameter portion 36 of the tool 20 is then struck with a hammer (not shown) to force the tool 20 down into the hole 24 of the substrate 26, and thus to force the sleeve portion 30 of the anchor 22 further down into the hole 24 of the substrate 26. Upon further downward movement of the sleeve portion 30 of the anchor 22 due to the force of the hammer strike(s), a second end 42 of the sleeve portion 30 of the anchor 22 contacts the enlarged head portion 32 of the cone portion 28 of the anchor 22. As the enlarged head portion 32 of the cone portion 28 of the anchor 22 is set against the base 34 of the hole 24, the second end 42 of the sleeve portion 30 of the anchor 22 is deformed such that it pushes against the hole wall proximate to the second end 42 thereof, and such that the anchor 22 is set and secured within the hole 24 of the substrate 26. The tool 20 is then removed from the hole 24 of the substrate 26.

The deformation of the sleeve portion 30 of the anchor 22 occurs more at the second end 42 thereof than at the first end 42 thereof, such that the securement of the anchor 22 within the hole 24 is stronger proximate to the second end 42 of the sleeve portion 30 than proximate to the first end 40 of the sleeve portion 30, as the amount of pressure with which the sleeve portion 30 exerts against the hole wall is greater at the second end 42 thereof than at the first end 40 thereof.

A second prior art tool 20*a* for setting an anchor 22*a* within a hole 24*a* of a substrate 26*a* is illustrated in FIGS. 3 and 4. The tool 20*a* is very similar to the tool 20 except for some minor differences. As illustrated in FIGS. 3 and 4, the tool 20*a*, the anchor 22*a* does not need to be of the bottom-setting type such that it needs to abut against a base of the hole 24*a*. The reason the anchor 22*a* does not need to be of the bottom-setting type because the stem 38*a* of the tool 20*a* is externally threaded such that it is threadedly engaged with an inner wall of the cone portion 28*a* of the anchor 22*a* such that the anchor 22*a* is held in place by the stem 38*a* of the anchor 22*a* during the installation process. The tool 20*a* also has a first enlarged diameter portion 36*a* and a second enlarged diameter portion 36*b*. The first enlarged diameter portion 36*a* has a diameter which is larger than the diameter of the hole 24*a* of the substrate 26*a* such that the first enlarged diameter portion 36*a* bears on the surface of the substrate 26*a* during the installation process. The second enlarged diameter portion 36*b* has a diameter which is slightly smaller than the diameter of the hole 24*a* of the substrate 26*a* and extends through, and is capable of moving within, the first enlarged diameter portion 36*a*.

In operation, the second enlarged diameter portion 36*b* of the tool 20*a* abuts against a first end 40*a* of the sleeve portion 30*a* of the anchor 22*a*. The second enlarged diameter portion 36*b* of the tool 20*a* is then struck with a hammer (not shown) to force the second enlarged diameter portion 36*b* down into the hole 24*a* of the substrate 26*a*, and thus to force the sleeve portion 30*a* of the anchor 22*a* further down into the hole 24*a* of the substrate 26*a*. Upon further downward movement of the sleeve portion 30*a* of the anchor 22*a* due to the force of the hammer strike(s), a second end 42*a* of the sleeve portion 30*a* of the anchor 22*a* contacts the enlarged head portion 32*a* of the cone portion 28*a* of the anchor 22*a*. As the anchor 22*a* is set in place within the hole 24*a* because of the threaded engagement between the stem 38*a* of the tool 20*a* and the cone portion 28*a* of the anchor 22*a*, the second end 42*a* of the sleeve portion 30*a* of the anchor 22*a* is deformed such that it pushes against the hole wall proximate to the second end 42*a* thereof, and such that the anchor 22*a* is set and secured within the hole 24*a* of the substrate 26*a*. The stem 38*a* is then disengaged from the anchor 22*a* and the tool 20*a* is removed from the hole 24*a* of the substrate 26*a*.

The deformation of the sleeve portion 30*a* of the anchor 22*a* occurs more at the second end 42*a* thereof than at the first end 40*a* thereof, such that the securement of the anchor 22*a* within the hole 24*a* is stronger proximate to the second end 42*a* of the sleeve portion 30*a* than proximate to the first end 40*a* of the sleeve portion 30*a*, as the amount of pressure with which the sleeve portion 30*a* exerts against the hole wall is greater at the second end 42*a* thereof than at the first end 40*a* thereof.

These prior art methods have a number of disadvantages associated with them. First of all, if the anchors must be of the bottom-setting type, they require that the hole depth in the substrate media have a bearing thickness equal to or greater than the diameter of three anchors. Installation hole depth of these types of anchors is critical and is dependent on the operator to ensure proper holding value. Second, the tools used for setting the anchors require a hammer strike to set the anchors. Problems can occur if the material in which the anchor is to be set is fractal or brittle as the hammer strike can initiate a crack in the substrate that can compromise the holding ability of the anchor. Third, the securement of the anchors to the hole wall are provided mainly only at one end of the anchor, such that if the pressure securing the anchor to the wall at the one end of the anchor is compromised for one reason or the other, such that the anchor may not have the proper holding value.

Thus, there is a need for an installation tool used for setting caulk-in anchors which overcomes the disadvantages of the prior art installation tools used for setting caulk-in anchors. The present invention provides for such an installation tool used for setting caulk-in anchors.

OBJECTS AND SUMMARY OF THE INVENTION

A primary object of the invention is to provide an installation tool which utilizes the mechanical advantage of a threaded shaft incorporated in the tool and a power driver to improve consistency of the holding reliability of the anchor and controls the anchor setting process to insure proper installation while reducing installation time.

Another primary object of the invention is to provide an installation tool for setting anchors which utilizes a combination of a threaded shaft and a controlled sensing spring to insure consistent installation with a visual check of proper setting of the anchor.

An object of the invention is to provide an installation tool for setting anchors which does not rely on bottom setting or a hammer strike to set the anchor.

Another object of the invention is to provide an installation tool for setting anchors at a depth independent of hole depth.

Another object of the invention is to provide an installation tool for setting anchors in a through hole in a substrate.

Another object of the invention is to provide an installation tool which has a stop cavity to prevent overdrawing a cone of the anchor into a compression medium of the anchor.

Yet another object of the invention is to provide an installation tool which provides an improved securement of the anchor to the substrate in comparison to prior art installation tools.

Briefly, and in accordance with the foregoing, the invention provides an installation tool for use with a battery operated drill or a corded electric drill for repetitive installation of caulk-in anchors. The installation tool utilizes the mechanical advantage of a threaded shaft to improve consistency of the holding reliability of the caulk-in anchor and controls the anchor setting process to insure proper installation while reducing installation time. The installation tool does not rely on bottom setting or a hammer strike to set the anchor, but can be set at a depth independent of hole depth. In one embodiment of the invention, the installation tool can be used with a through hole in the substrate and uses a combination of a threaded shaft and a controlled sensing spring to insure a more uniform installation of the anchor within the substrate across the entire length of the sleeve portion of the anchor, along with a visual check of proper setting of the anchor.

BRIEF DESCRIPTION OF THE DRAWINGS

The features of the invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENT

Figure 1:
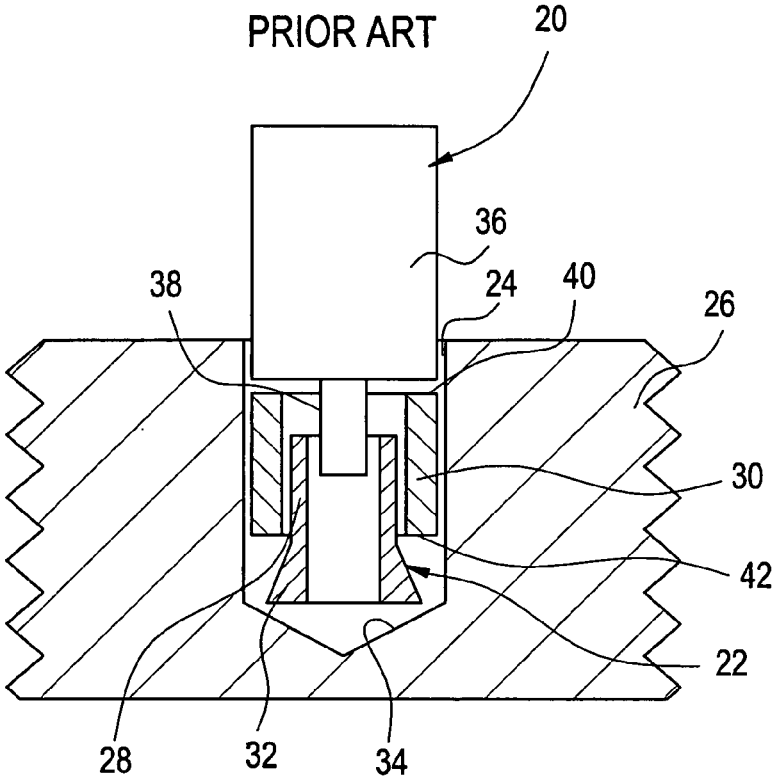
FIG. 1 PRIOR ART
FIGS. 1 and 2 are partial cross-sectional side-elevational views of a prior art setting tool which illustrate the prior art setting tool setting an anchor within an aperture of a substrate.
Figure 2:
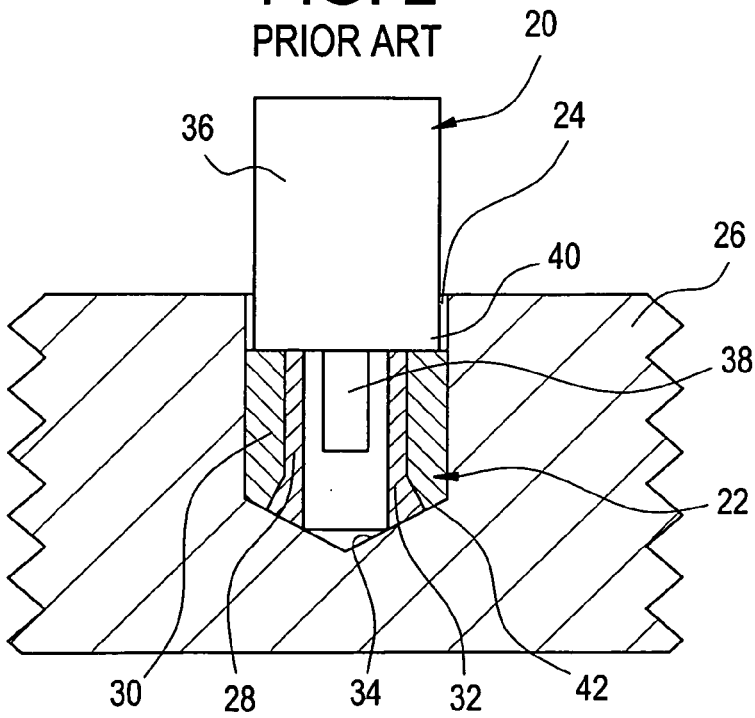
FIG. 2 PRIOR ART
Figure 3:
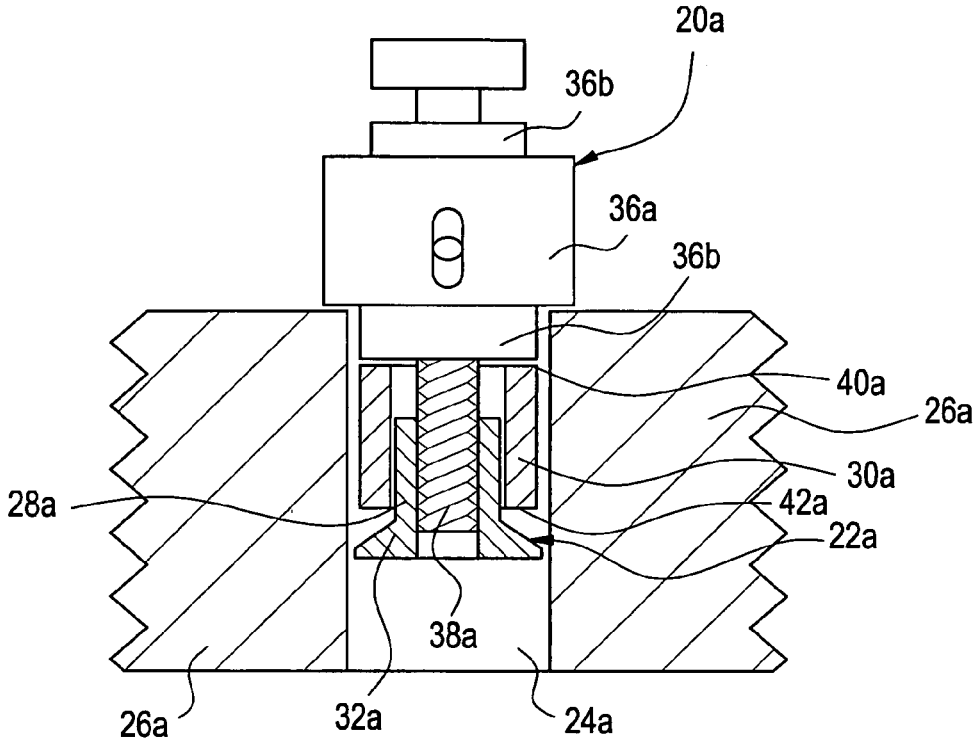
FIG. 3 PRIOR ART
FIGS. 3 and 4 are partial cross-sectional side-elevational views of a prior art setting tool which illustrate the prior art setting tool setting an anchor within an aperture of a substrate.
Figure 4:
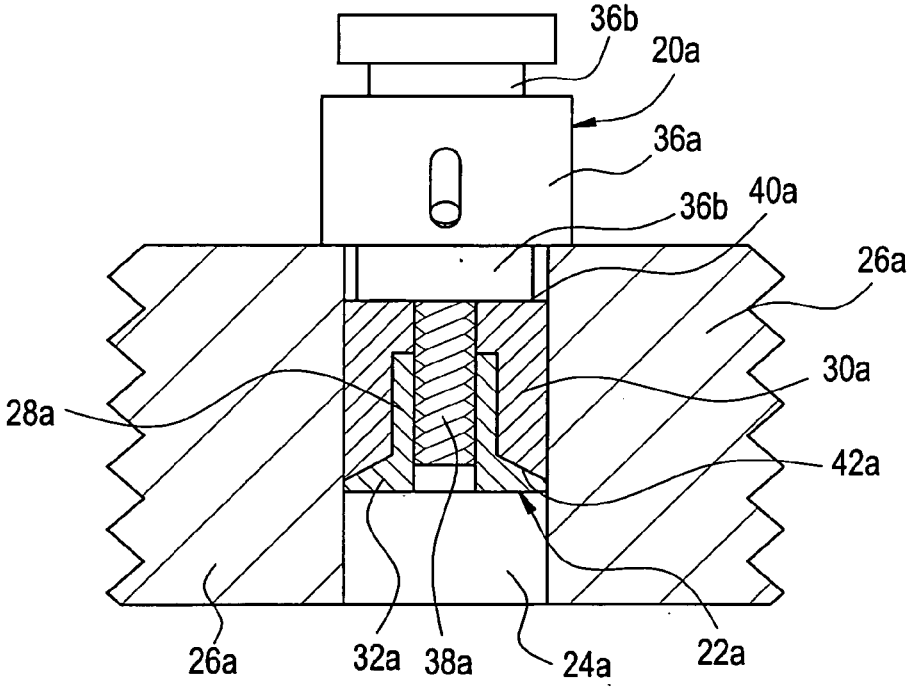
FIG. 4 PRIOR ART

While this invention may be susceptible to embodiment in different forms, there is shown in the drawings and will be described herein in detail, specific embodiments with the understanding that the present disclosure is to be considered an exemplification of the principles of the invention, and is not intended to limit the invention to that as illustrated.

Attention is now directed to the two embodiments of the setting tool 120, 320. A first embodiment of the setting tool 120 is shown in FIGS. 5–13. A second embodiment of the setting tool 320 is shown in FIGS. 14–18. Like elements are denoted with like reference numerals with the first embodiment being in the one and two hundreds, and the second embodiment being in the three and four hundreds.

Figure 5:
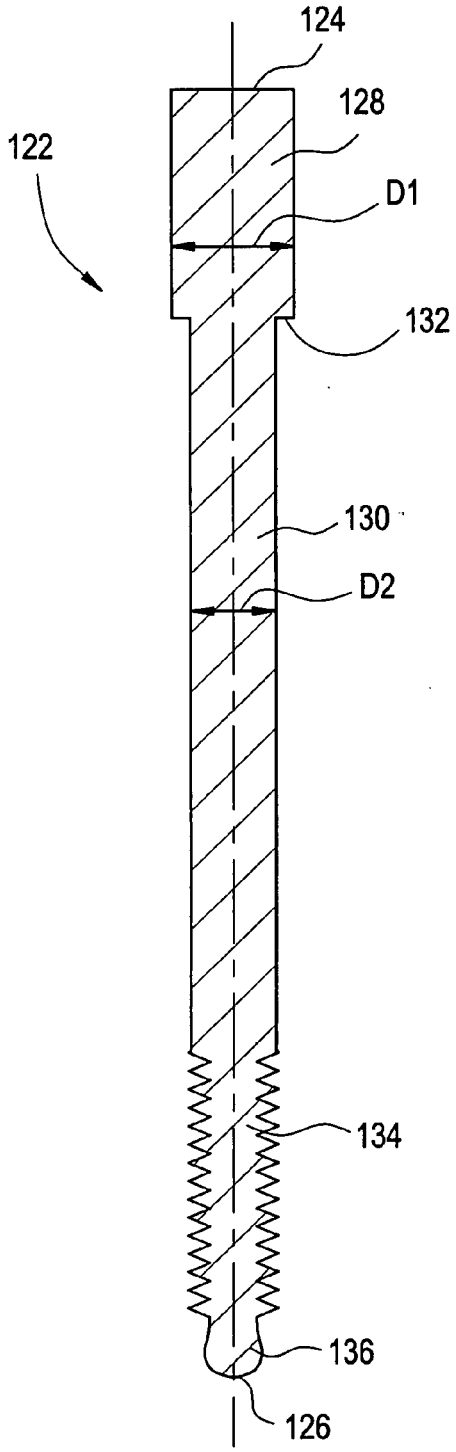
FIG. 5 is a cross-sectional side-elevational view of a tool shaft of a setting tool in accordance with a first embodiment of the present invention.
Figure 7:
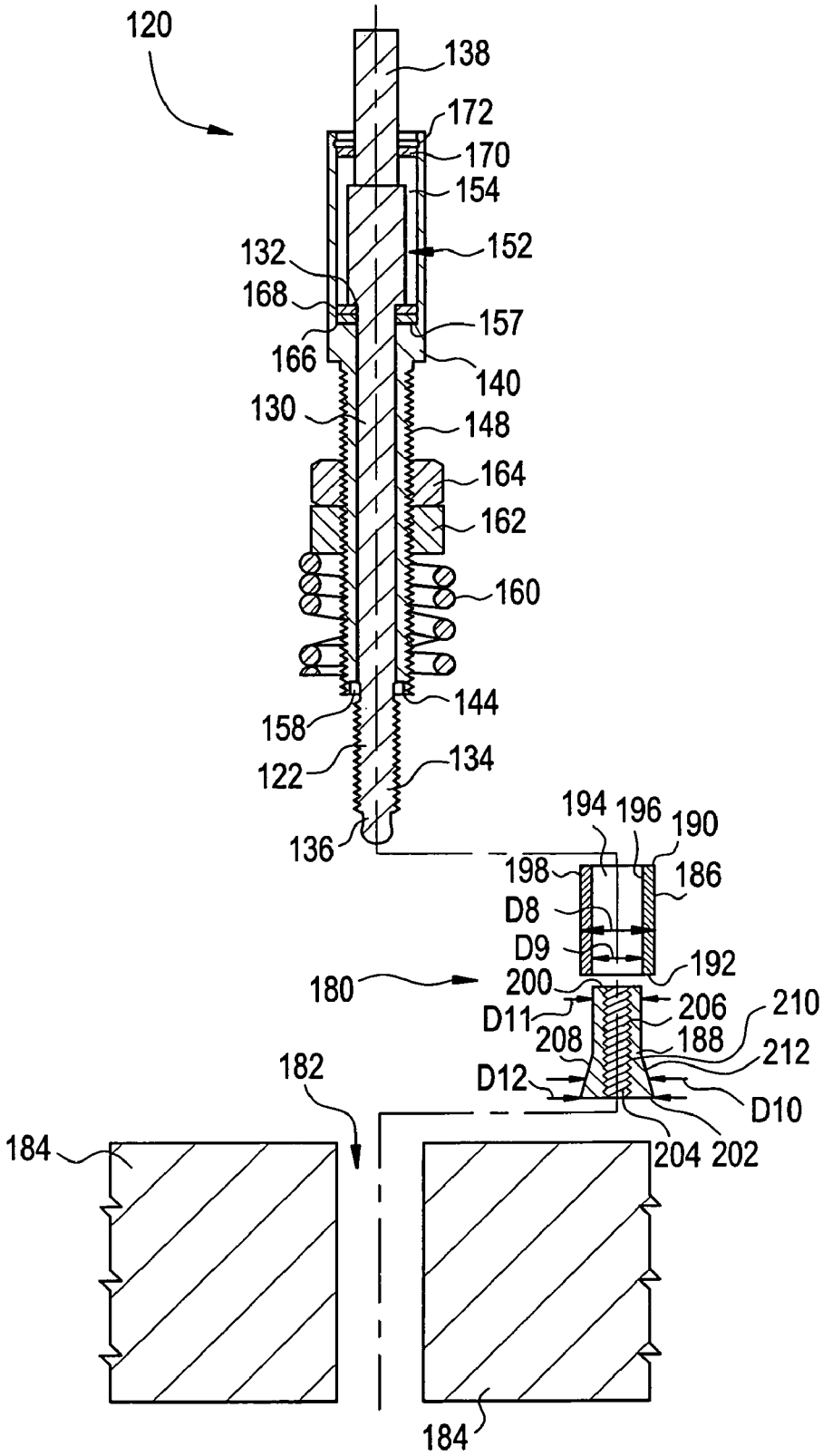
FIGS. 7–9 are cross-sectional side-elevational views of the setting tool in accordance with the first embodiment of the present invention which illustrate the setting tool setting an anchor within an aperture of a substrate.

FIG. 7 illustrates a setting tool 120 of the first embodiment of the present invention. The setting tool 120 has a tool shaft 122. As best illustrated in FIG. 5, the tool shaft 122 has a first end 124 and a second end 126. At the first end 124 of the tool shaft 122, the tool shaft 122 has a first portion 128 which has a diameter D1. Extending from the first portion 128, the tool shaft 122 has a second portion 130 which has a diameter D2, with diameter D1 being larger than diameter D2, such that a shoulder 132 is defined between the first and second portions 128, 130 of the tool shaft 122. Extending from the second portion 130, the tool shaft 122 has a third portion 134 which is externally threaded and which has a diameter which is substantially commensurate with the diameter D2 of the second portion 130 of the tool shaft 122. Extending from the third portion 134, the tool shaft 122 has a tip portion 136, which extends to the second end 126 of the tool shaft 122.

The setting tool 120 has a tool adaptor 138 which is fixed to, and extends from, the first end 124 of the tool shaft 122 in the opposite direction as the first portion 128 of the tool shaft 122. The tool adaptor 138 may be integrally formed with the tool shaft 122. The tool adaptor 138 is preferably formed and sized such that it can be inserted into a drill chuck (not shown) of either a corded electric or battery-operated drill (not shown).

Figure 6:
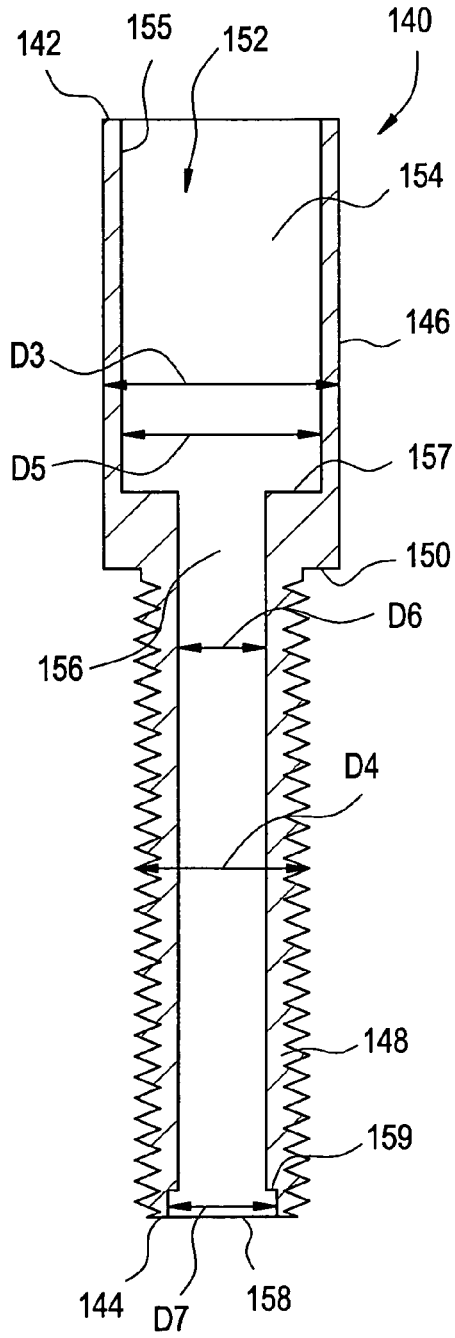
FIG. 6 is a cross-sectional side-elevational view of a tool body of the setting tool in accordance with the first embodiment of the present invention.

The setting tool 120 has a tool body 140. As best illustrated in FIG. 6, the tool body 140 has a first end 142 and a second end 144. At the first end 142 of the tool body 140, the tool body 140 has a first portion 146 which has a diameter D3. Extending from the first portion 146 to the second end 144 of the tool body 140, the tool body 140 has a second portion 148 which has a diameter D4, with diameter D3 being larger than diameter D4, such that a shoulder 150 is defined between the first and second portions 146, 148 of the tool body 140. The second portion 148 of the tool body 140 is externally threaded.

The tool body 140 also has an aperture 152 provided entirely therethrough such that it extends from the first end 142 of the tool body 140 to the second end 144 of the tool body 140. A first portion 154 of the aperture 152 has an inner diameter D5 and extends from the first end 142 of the tool body 140 to a position within the first portion 146 of the tool body 140, but proximate to the shoulder 150. The diameter D5 is smaller than the diameter D3, but is larger than the diameters D1 and D2 of the tool shaft 122. Proximate to the first end 142 of the tool body 140, a notch 155 is provided in the first portion 146 of the tool body 140 which is in communication with the first portion 154 of the aperture 152. A second portion 156 of the aperture 152 has an inner diameter D6 and extends from the first portion 154 of the aperture 152 to a position within the second portion 148 of the tool body 140 which is proximate to the second end 144 of the tool body 140. The diameter D6 is smaller than the diameters D1, D4 and D5, but is slightly larger than the diameter D2, such that a shoulder 157 is defined between the first and second portions 154, 156 of the aperture 152. A third portion 158, also referred to as a stop cavity, of the aperture 152 has an inner diameter D7 and extends from the second portion 156 of the aperture 152 to the second end 144 of the tool body 140. The diameter D7 is larger than the diameters D2 and D6, but is smaller than the diameter D4, such that a shoulder 159 is defined between the second and third portions 156, 158 of the aperture 152.

As illustrated in FIG. 7, the setting tool 120 includes a normally expanded spring 160 and a pair of nut members 162, 164. The nut member 162 is a spring retainer nut and the nut member 164 is a jam nut. The nut members 162, 164 have apertures (not shown) therethrough which define aperture walls (not shown), which are threaded. The apertures of the nut members 162, 164 preferably have diameters which are slightly larger than the diameter D4 of the tool body 140 such that the threaded aperture walls of the nut members 162, 164 are capable of engaging with the externally threaded second portion 148 of the tool body 140.

Figure 10:
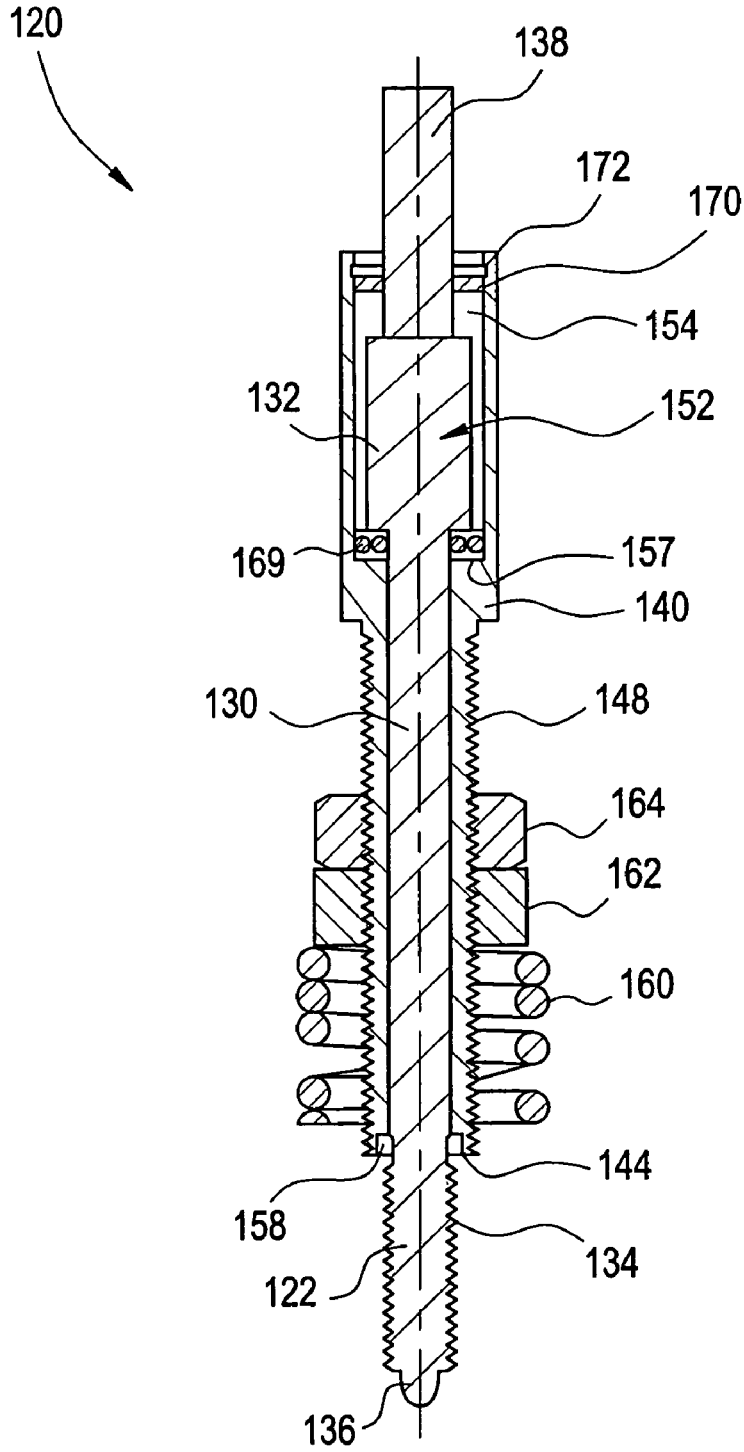
FIG. 10 is a cross-sectional side-elevational view of the setting tool in accordance with an alternative version of the first embodiment of the present invention.

The setting tool 120 further includes a washer 166 and a bearing 168, each of which has an aperture (not shown) therethrough which are of a diameter which is slightly larger than the diameter D2 of the second portion 126 of the tool shaft 122, but which is smaller than the diameter D1 of the first portion 124 of the tool shaft 122. Alternatively, as shown in FIG. 10, the setting tool 120 could utilize a ball bearing 169 instead of the washer 166 and bearing 168. The ball bearing 169 has an aperture (not shown) therethrough which is of a diameter which is slightly larger than the diameter D2 of the second portion 126 of the tool shaft 122, but which is smaller than the diameter D1 of the first portion 124 of the tool shaft 122. The ball bearing 169 would reduce friction in comparison to the washer 166 and the bearing 168. When the ball bearing 169 is used, the tool body 140 is hardened to prevent body wear from the hardened ball bearing 169.

The setting tool 120 further includes a washer 170 and a c-clamp 172, each of which are sized to fit around the tool adaptor 138.

As best illustrated in FIG. 7, the setting tool 120 is configured by inserting the washer 166 into the first portion 154 of the aperture 152 of the tool body 140 such that the washer 166 rests on the shoulder 157 defined by the first and second portions 154, 156 of the aperture 152 such that the aperture of the washer 166 is in communication with the aperture 152.

The bearing 168 is inserted into the first portion 154 of the aperture 152 of the tool body 140 such that the bearing 168 rests on the washer 166, and such that the aperture of the bearing 168 is in communication with the aperture of the washer 166 and the aperture 152.

The tool shaft 122 is inserted into the tool body 140 by moving the tip portion 136 of the tool shaft 122 into the first portion 154 of the aperture 152 of the tool body 140, through the aperture of the bearing 168, through the aperture of the washer 166, through the second portion 156 of the aperture 152, and through the third portion 158 of the aperture 152. Insertion of the tool shaft 122 into the tool body 140 is complete when the shoulder 132 of the tool shaft 122 comes to rest on the bearing 168. In this position, the junction of the second and third portions 130, 134 of the tool shaft 122 is provided proximate to the junction of the second and third portions 156, 158 of the aperture 152 of the tool body 140, such that a majority of the third portion 134 of the tool shaft 122, and the tip portion 136 of the tool shaft 122, are positioned outside of the tool body 140. These portions of the tool shaft 122 which are positioned outside of the tool body 140 should have a length which is at least as long as a compression medium 186 of the anchor 180.

The washer 170 is then fit around the tool adaptor 138 within the first portion 154 of the aperture 152. The c-clamp 172 is then fit around the tool adaptor 138 within the first portion 154 of the aperture 152 and is positioned within the notch 155 such that the c-clamp 172 is secured within the tool body 140. As the c-clamp 172 is secured within the tool body 140, the tool shaft 122 is also secured within the tool body 140, but the tool shaft 122 is allowed to rotate within the tool body 140.

The nut members 162, 164 are then threadedly connected to the externally threaded second portion 148 of the tool body 140. The nut member 162 is set at a certain defined position along a length of the second portion 148 of the tool body 140 for reasons discussed hereinbelow.

The normally expanded spring 160 is then positioned around the second portion 148 of the tool body 140 between the nut member 162 and the second end 144 of the tool body 140 such that the nut member 162 is in contact with one end of the spring 160 and such that the other end of the spring 160 is substantially flush with the second end 144 of the tool body 140. The position of the nut member 162 on the second portion 148 of the tool body 140 determines the amount of the compression of the spring 160. Tightening the nut member 164 against the nut member 162 locks the spring 160 in position for repetitive operation which allows for consistent positioning of the anchor 180 within the aperture 182 of the substrate 184.

Once the setting tool 120 is properly configured, as described above, the setting tool 120 is capable of setting an anchor 180, preferably a caulk-in anchor, within an aperture 182 of a substrate 184, such as concrete, hollow block or brick. The aperture 182 can be drilled into the substrate 184 and must have a depth which is at least as long as the anchor 180 itself.

As best illustrated in FIG. 7, the anchor 180 includes a compression medium or sleeve 186 and an internally threaded cone 188. The compression medium 186 is preferably cylindrical, but is not so limited, and has first and second ends 190, 192. An aperture 194 extends entirely through the compression medium 186 from the first end 190 to the second end 192 such that an inner wall 196 and an outer wall 198 of the compression medium 186 are defined. The outer wall 198 of the compression medium 186 has a diameter D8, which is proximate in size to diameter D4 of the second portion 148 of the tool body 140. The diameter D8 is also slightly smaller than a diameter of the aperture 182 of the substrate 184. The inner wall 196 of the compression medium 186 has a diameter D9, which is smaller than diameter D8, but which is larger than diameter D2 of the tool shaft 122.

The internally threaded cone 188 has first and second ends 200, 202 and an aperture 204 which extends entirely through the internally threaded cone 188 from the first end 200 to the second end 202 such that an inner wall 206 and an outer wall 208 of the internally threaded cone 188 are defined. The inner wall 206 of the aperture 204 is threaded and the aperture 204 has a diameter D10 which is slightly larger than the diameter D2 of the tool shaft 122 such that the third portion 134 of the tool shaft 122 can be threadedly engaged with the inner wall 206 of the internally threaded cone 188. A first portion 210 of the outer wall 208 of the internally threaded cone 188 extends from the first end 200 of the internally threaded cone 188 toward the second end 202 of the internally threaded cone 188. The first portion 210 of the outer wall 208 has a diameter D11 which is larger than the diameter D10, but which is slightly smaller than the diameter D9 of the compression medium 186. The diameter D11 is also preferably slightly smaller than the diameter D7 of the tool body 140 such that the first end 200 of the internally threaded cone 188 can be inserted into the stop cavity 158 of the tool body 140. A second portion 212 of the outer wall 208 of the internally threaded cone 188 extends from the first portion 210 of the outer wall 208 to the second end 202 of the internally threaded cone 188. The second portion 212 of the outer wall 208 is tapered such that the outer wall 208 has a diameter D12 at the second end 202 of the internally threaded cone 188, which is larger than the diameter D11 at the first end 200 of the internally threaded cone 188. The diameter D12 is preferably commensurate with the diameter D8 of the compression medium 186. The second portion 212 of the outer wall 208 may also be provided with a plurality of ribs (not shown) extending therefrom. The internally threaded cone 188 is formed of a material which is harder than a material from which the compression medium 186 is formed, preferably the internally threaded cone 188 is formed of a material which is three times as strong as the material from which the compression medium 186 is formed. For instance, the compression medium 186 could be formed of zinc and the internally threaded cone 188 could be formed of lead, or the compression medium 186 could be formed of aluminum or plastic, while the internally threaded cone 188 is formed of steel.

The internally threaded cone 188 is inserted into the aperture 194, of the compression medium 186 by inserting the first end 200 of the internally threaded cone 188 into the aperture 194 at the second end 192 of the compression medium 186 until the second portion 212 of the outer wall 208 abuts against the second end 192 of the compression medium 186. The first end 200 of the internally threaded cone 188 is thus distanced from the first end 190 of the compression medium 186, as illustrated in FIG. 8.

Figure 8:
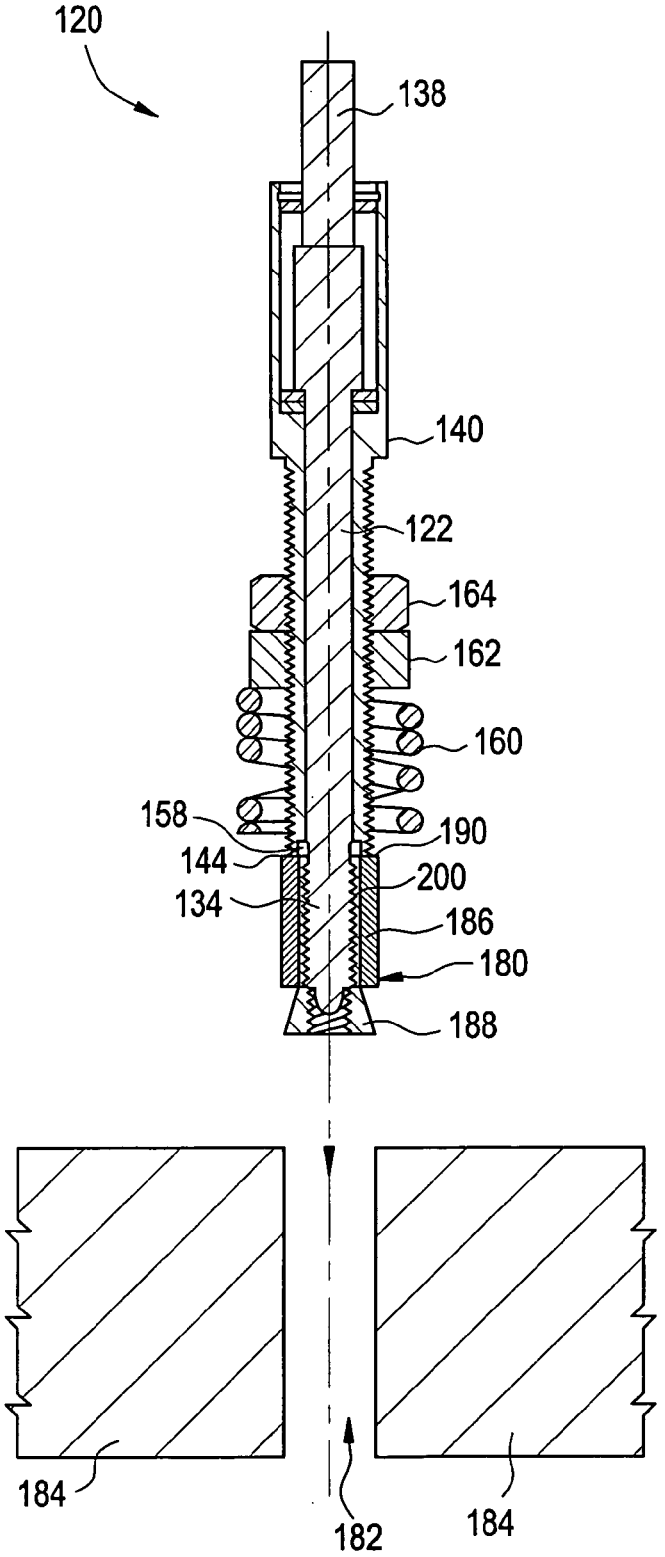

As illustrated in FIG. 8, the anchor 180 is connected to the setting tool 120 by threading the internally threaded cone 188 onto the third portion 134 of the tool shaft 122, either by hand or by triggering the drill (not shown), until the first end 190 of the compression medium 186 abuts against the second end 144 of the tool body 140.

The setting tool 120 is then aligned with the aperture 182 of the substrate 184 and is moved toward the aperture 182 of the substrate 184 in order to position the anchor 180 within the aperture 182 of the substrate 184. This movement is continued until the spring 160 is positioned against the substrate 184. The position of the nut members 162, 164 lock the spring 160 into position to allow for repetitive operation and further allows for consistent positioning of the anchor 180 within the aperture 182 of the substrate 184. The nut members 162, 164 also provide a way of positioning the anchor 180 at various depths within the various substrates.

Figure 9:
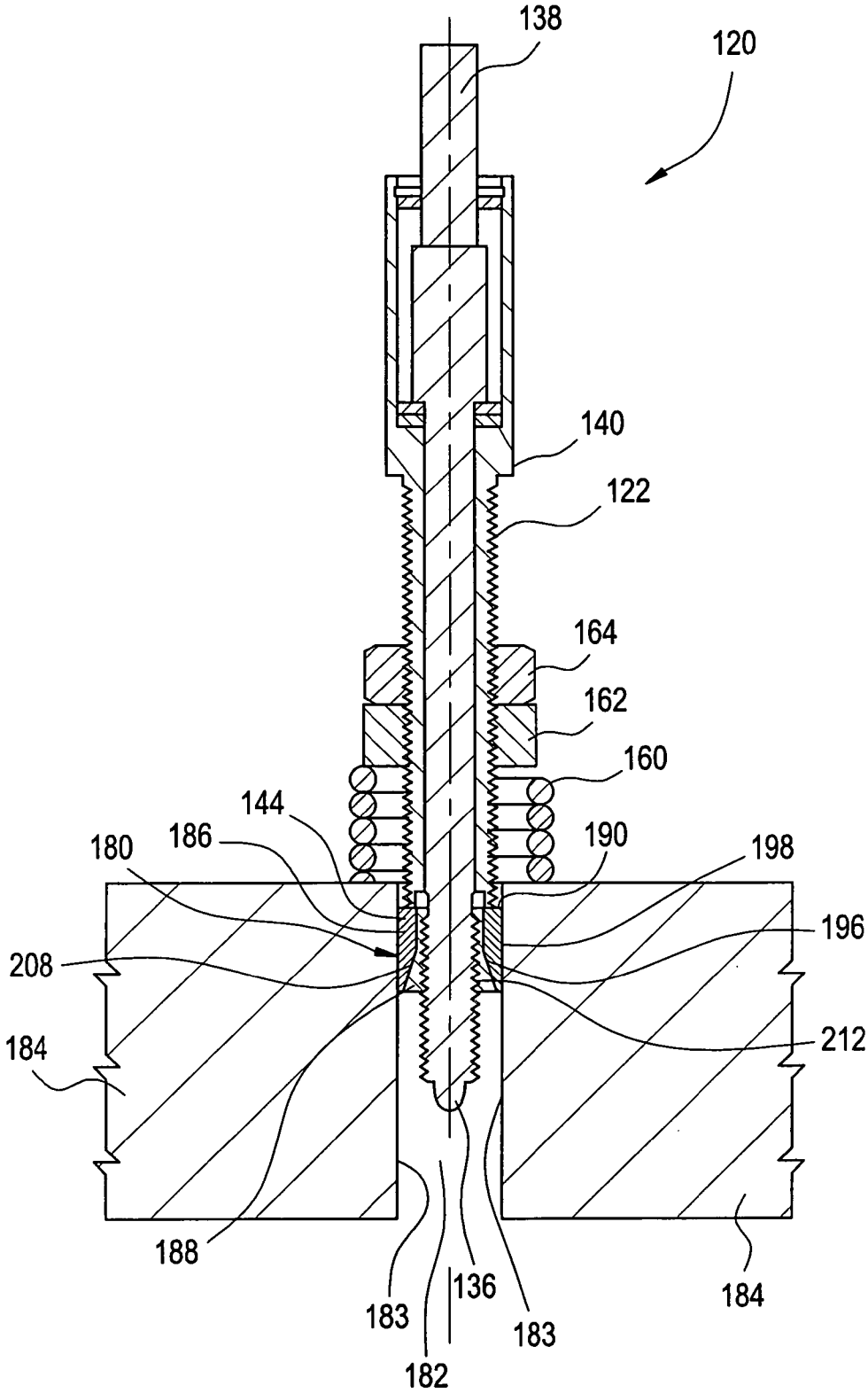

The operator then applies a slight pressure to the setting tool 120 in order to hold the setting tool 120 on the substrate 184 and to prevent rotation of the setting tool 120 on the substrate 184. The operator then actuates the drill (not shown) such that the tool shaft 122 is rotated. As the tool shaft 122 is rotated, and because the spring 160 is held against the substrate 184, the anchor 180 is drawn up by the tool shaft 122 and the setting process of the anchor 180 in the aperture 182 of the substrate 184 is begun, as illustrated in FIG. 9.

During the setting process of the anchor 180, different things happen simultaneously to set the anchor 180 in the aperture 182 of the substrate 184. One is that as pressure is applied to the setting tool 120 and the tool shaft 122 is rotated, the internally threaded cone 188 of the anchor 180 is drawn into the compression medium 186. To prevent rotation of the compression medium 186 as the internally threaded cone 188 is drawn into the compression medium 186 by the tool shaft 122, either the compression medium 186 at its first end 190, or the tool body 140 at its second end 144, or both, is provided with a plurality of anti-rotation ribs (not shown). The second end 144 of the tool body 140 also applies a downward load on the compression medium 186, thus compressing the compression medium 186 and controlling the upward flow of the compression medium 186 in the aperture 182 of the substrate 184. Further, the plurality of ribs (not shown) on the second portion 212 of the outer wall 208 of the internally threaded cone 188 prevent rotation of the internally threaded cone 188 relative to the compression medium 186 as the internally threaded cone 188 is drawn into the compression medium 186.

Figure 11:
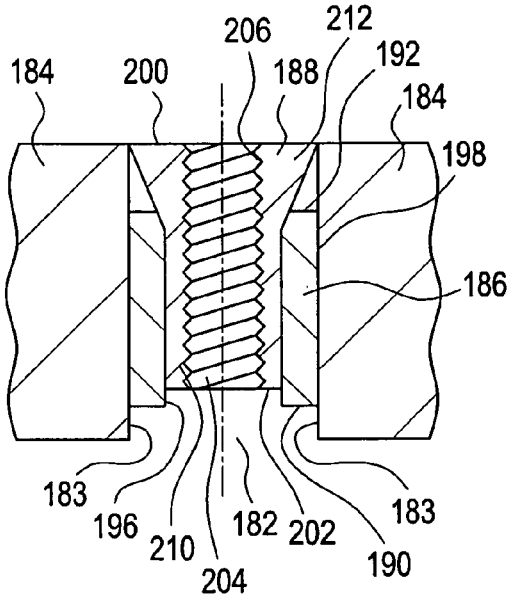
FIGS. 11–13 are cross-sectional side-elevational views of the anchor being set within the hole of the substrate in accordance with the first embodiment of the present invention.
Figure 12:
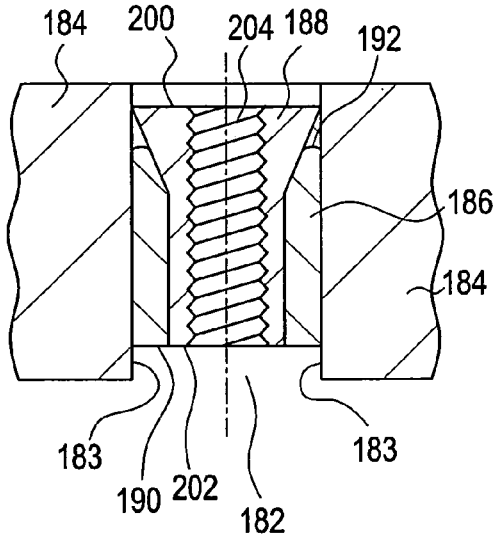
Figure 13:
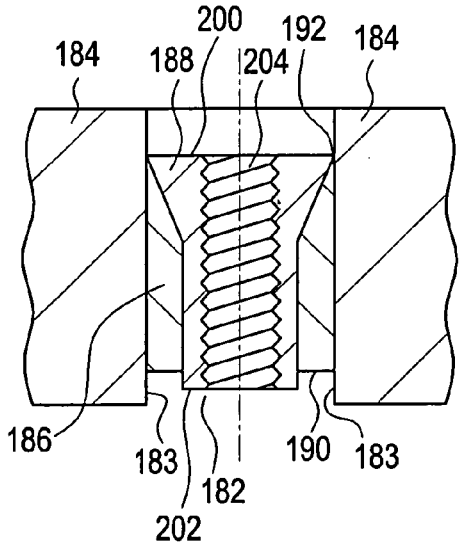

As the internally threaded cone 188 is drawn into the compression medium 186, the second portion 212 thereof pushes against the inner wall 196 of the compression medium 186, such that the outer wall 198 of the compression medium 186, proximate to the second end 192 thereof, exerts a controlled radial force against an aperture wall 183, which is defined by the aperture 182, of the substrate 184, and such that the compression medium 186 is deformed by the internally threaded cone 188, as illustrated in FIGS. 11–13. The pressure exerted on the compression medium 186 by the internally threaded cone 188 and the pressure exerted on the aperture wall 183 by the compression medium 186 function to lock the anchor 180 within the aperture 182 of the substrate 184.

As the second portion 212 of the internally threaded cone 188 is drawn into the compression medium 186, the first end 200 of the internally threaded cone 188 is drawn into the stop cavity 158 of the tool body 140. The external threading of the third portion 134 of the tool shaft 122 preferably extends above the stop cavity 158 to allow the internally threaded cone 188 to be pulled into the stop cavity 158. The stop cavity 158 is of a diameter D7, which is larger than the diameter D11 of the anchor 180, in order to allow for the first end 200 of the internally threaded cone 188 to be drawn into the stop cavity 158 and to allow for an alignment guide during the setting process. Once the first end 200 of the internally threaded cone 188 abuts against the shoulder 159 of the tool body 140, the internally threaded cone 188 has properly expanded the compression medium 186 to its optimum expansion against the aperture wall 183 of the substrate 184. The stop cavity 158 can be provided with a depth that is predetermined to ensure that once the first end 200 of the internally threaded cone 188 abuts against the shoulder 159, the internally threaded cone 188 has properly expanded the compression medium 186 to its optimum expansion against the aperture wall 183 of the substrate 184. The stop cavity 158 prevents overdrawing of the internally threaded cone 188 into the compression medium 186.

As the foregoing is happening, the spring 160 is being compressed between the nut member 162 and the substrate 184. The operator is provided notice that the anchor 180 is properly set in the substrate 184 once the spring 160 is compressed as much as it can be, such that it solids up.

The spring 160 performs a number of functions during the setting process of the anchor 180 within the substrate 184 such as absorbing shock, preventing rotation of the setting tool 120 to allow for one-hand installation, allowing for the travel distance of the internally threaded cone 188 of the anchor 180 which is needed to begin expansion of the compression medium 186 against the aperture wall 183 of the substrate 184, and allowing for the downward travel of the setting tool 120 into the aperture 182 of the substrate 184 to further expand the compression medium 186 at the first end 190 thereof.

Once the anchor 180 is set in the aperture 182 of the substrate 184, the tool shaft 122 can be removed from the anchor 180 by switching the drill (not shown) into reverse until it is extracted from the anchor 180. Once the setting tool 120 is removed from the anchor 180, the operator can perform an additional visual check to ensure that the anchor 180 is properly set by making sure that the first end 200 of the internally threaded cone 188 is above the first end 190 of the compression medium 186, as illustrated in FIG. 13.

Thus, the tool 120 does not require the anchor 180 to be of the bottom-setting type. The tool 120 also does not require a hammer strike to set the anchor 180. Further, the securement of the anchor 180 to the aperture wall 183 are provided at both ends 190, 192 of the anchor 180 to ensure that the anchor 180 has the proper holding value.

Figure 14:
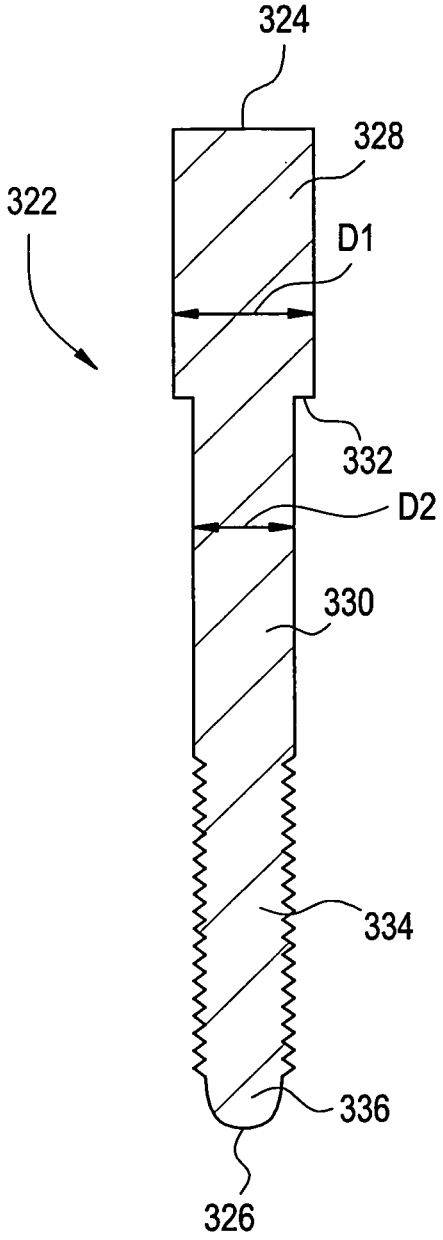
FIG. 14 is a cross-sectional side-elevational view of a tool shaft of a setting tool in accordance with a second embodiment of the present invention.

Attention is now directed to the second embodiment of the setting tool 320 which is illustrated in FIGS. 14–18. The setting tool 320 has a tool shaft 322. As best illustrated in FIG. 14, the tool shaft 322 has a first end 324 and a second end 326. At the first end 324 of the tool shaft 322, the tool shaft 322 has a first portion 328 which has a diameter D1. Extending from the first portion 328, the tool shaft 322 has a second portion 330 which has a diameter D2, with diameter D1 being larger than diameter D2, such that a shoulder 332 is defined between the first and second portions 328, 330 of the tool shaft 322. Extending from the second portion 330, the tool shaft 322 has a third portion 334 which is externally threaded and which has a diameter which is substantially commensurate with the diameter D2 of the second portion 330 of the tool shaft 322. Extending from the third portion 334, the tool shaft 322 has a tip portion 336, which extends to the second end 326 of the tool shaft 322.

Figure 16:
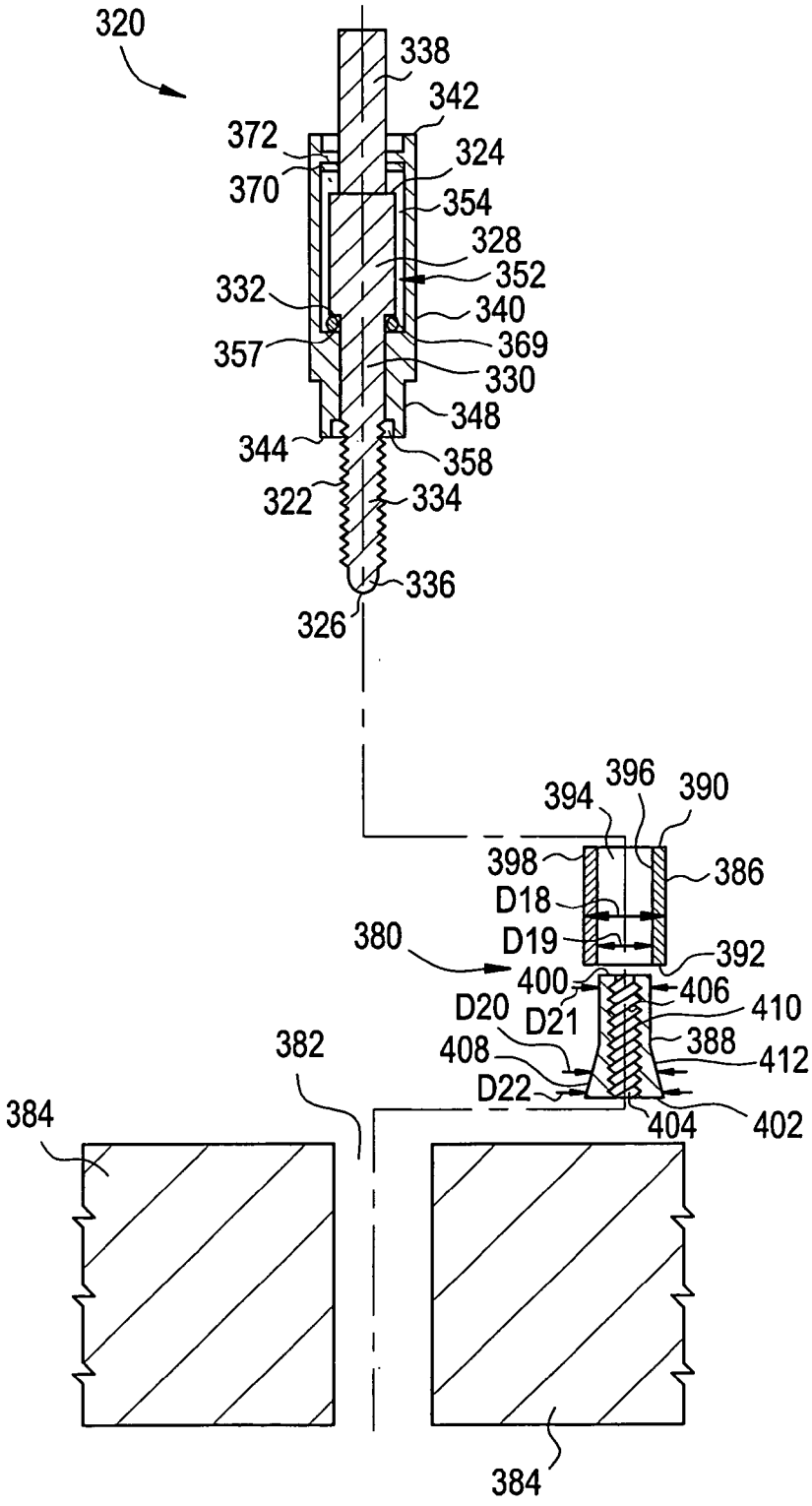
FIGS. 16–18 are cross-sectional side-elevational views of the setting tool in accordance with the second embodiment of the present invention which illustrate the setting tool setting an anchor within an aperture of a substrate.

As illustrated in FIG. 16, the setting tool 320 has a tool adaptor 338 which is fixed to, and extends from, the first end 324 of the tool shaft 322 in the opposite direction as the first portion 328 of the tool shaft 322. The tool adaptor 338 may be integrally formed with the tool shaft 322. The tool adaptor 338 is preferably formed and sized such that it can be inserted into a drill chuck (not shown) of either a corded electric or battery-operated drill (not shown).

Figure 15:
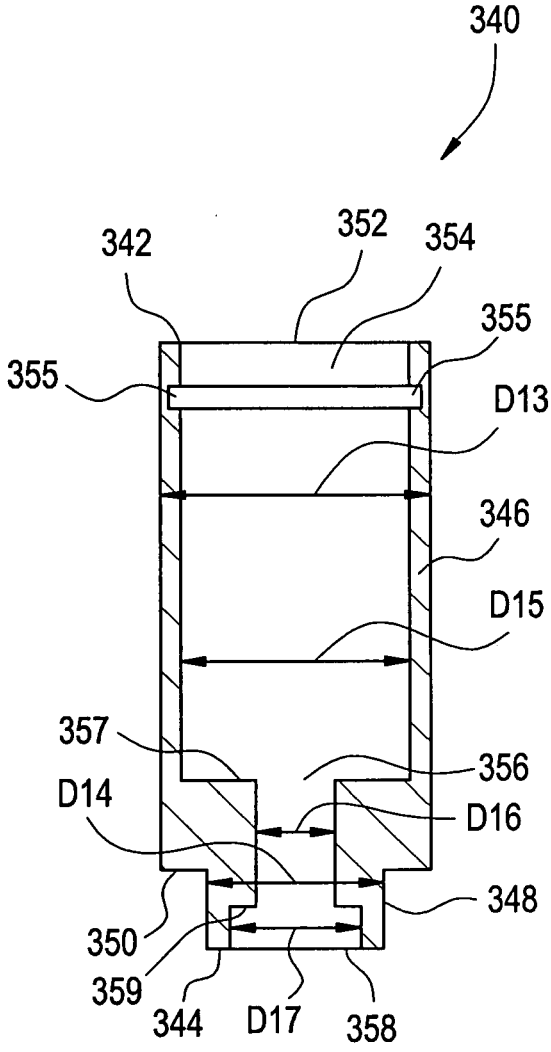
FIG. 15 is a cross-sectional side-elevational view of a tool body of the setting tool in accordance with the second embodiment of the present invention.

The setting tool has a tool body 340. As best illustrated in FIG. 15, the tool body 340 has a first end 342 and a second end 344. At the first end 342 of the tool body 340, the tool body 340 has a first portion 346 which has a diameter D13. Extending from the first portion 346 to the second end 344 of the tool body 340, the tool body 340 has a second portion 348 which has a diameter D14, with diameter D13 being larger than diameter D14, such that a shoulder 350 is defined between the first and second portions 346, 348 of the tool body 340.

The tool body 340 also has an aperture 352 provided entirely therethrough such that it extends from the first end 342 of the tool body 340 to the second end 344 of the tool body 340. A first portion 354 of the aperture 352 has an inner diameter D15 and extends from the first end 352 of the tool body 340 to a position within the first portion 346 of the tool body 340, but proximate to the shoulder 350. The diameter D15 is smaller than the diameter D13, but is larger than the diameters D1 and D2 of the tool shaft 322. Proximate to the first end 342 of the tool body 340, a notch 355 is provided in the first portion 346 of the tool body 340 which is in communication with the first portion 354 of the aperture 352. A second portion 356 of the aperture 352 has an inner diameter D16 and extends from the first portion 354 of the aperture 352 to a position within the second portion 348 of the tool body 340 which is proximate to the second end 344 of the tool body 340. The diameter D16 is smaller than the diameters D1, D14, D15, but is slightly larger than the diameter D2, such that a shoulder 357 is defined between the first and second portions 354, 356 of the aperture 352. A third portion 358, also referred to as a stop cavity, of the aperture 352 has an inner diameter D17 and extends from the second portion 356 of the aperture 352 to the second end 344 of the tool body 340. The diameter D17 is larger than the diameters D2 and D16, but is smaller than the diameter D14, such that a shoulder 359 is defined between the second and third portions 356, 358 of the aperture 352.

The setting tool 320 further includes a ball bearing 369 which has an aperture (not shown) therethrough which is of a diameter which is slightly larger than the diameter D2 of the second portion 326 of the tool shaft 322, but which is smaller than the diameter D1 of the 5 first portion 324 of the tool shaft 322. Alternatively, the setting tool 320 could utilize a washer and bearing assembly (not shown, but similar to washer 166 and bearing 168 of the first embodiment) instead of the ball bearing 369. The ball bearing 369, though, reduces friction in comparison to the washer and the bearing. When the ball bearing 369 is used, the tool body 340 is hardened to prevent body wear from the hardened ball bearing 369.

The setting tool 320 further includes a washer 370 and a c-clamp 372, each of which are sized to fit around the tool adaptor 338.

As best illustrated in FIG. 16, the setting tool 320 is configured by inserting the ball bearing 369 into the first portion 354 of the aperture 352 of the tool body 340 such that the ball bearing 369 rests on the shoulder 357 defined by the first and second portions 354, 356 of the aperture 352 such that the aperture of the ball bearing 369 is in communication with the aperture 352.

The tool shaft 322 is inserted into the tool body 340 by moving the tip portion 336 of the tool shaft 322 into the first portion 354 of the aperture 352 of the tool body 340, through the aperture of the ball bearing 369, through the second portion 356 of the aperture 352, and through the third portion 358 of the aperture 352. Insertion of the tool shaft 322 into the tool body 340 is complete when the shoulder 332 of the tool shaft 322 comes to rest on the ball bearing 369. In this position, the junction of the second and third portions 330, 334 of the tool shaft 322 is provided proximate to the junction of the second and third portions 356, 358 of the aperture 352 of the tool body 340, such that a majority of the third portion 334 of the tool shaft 322, and the tip portion 336 of the tool shaft 322, are positioned outside of the tool body 340. These portions of the tool shaft 322 which are positioned outside of the tool body 340 should have a length which is at least as long as a compression medium 386 of the anchor 380.

The washer 370 is then fit around the tool adaptor 338 within the first portion 354 of the aperture 352. The c-clamp 372 is then fit around the tool adaptor 338 within the first portion 354 of the aperture 352 and is positioned within the notch 355 such that the c-clamp 372 is secured within the tool body 340. As the c-clamp 372 is secured within the tool body 340, the tool shaft 322 is also secured within the tool body 340, but the tool shaft 322 is allowed to rotate within the tool body 340.

Once the setting tool 320 is properly configured, as described above, the setting tool 320 is capable of setting an anchor 380, preferably a caulk-in anchor, within an aperture 382 of a substrate 384, such as concrete, hollow block or brick. The aperture 382 can be drilled into the substrate 384 and must have a depth which is at least as long as the anchor 380 itself.

As best illustrated in FIG. 16, the anchor 380 includes a compression medium or sleeve 386 and an internally threaded cone 388. The compression medium 386 is preferably cylindrical, but is not so limited, and has first and second ends 390, 392. An aperture 394 extends entirely through the compression medium 386 from the first end 390 to the second end 392 such that an inner wall 396 and an outer wall 398 of the compression medium 386 are defined. The outer wall 398 of the compression medium 386 has a diameter D18, which is proximate in size to diameter D14 of the second portion 348 of the tool body 340. The diameter D18 is also slightly smaller than a diameter of the aperture 382 of the substrate 384. The inner wall 396 of the compression medium 386 has a diameter D19, which is smaller than diameter D18, but which is larger than diameter D2 of the tool shaft 322.

The internally threaded cone 388 has first and second ends 400, 402 and an aperture 404 which extends entirely through the internally threaded cone 388 from the first end 400 to the second end 402 such that an inner wall 406 and an outer wall 408 of the internally threaded cone 388 are defined. The inner wall 406 of the aperture 404 is threaded and the aperture 404 has a diameter D20 which is slightly larger than the diameter D2 of the tool shaft 322 such that the third portion 334 of the tool shaft 322 can be threadedly engaged with the inner wall 406 of the internally threaded cone 388. A first portion 410 of the outer wall 408 of the internally threaded cone 388. A first portion 410 of the outer wall 408 of the internally threaded cone 388 extends from the first end 400 of the internally threaded cone 388 toward the second end 402 of the internally threaded cone 388. The first portion 410 of the outer wall 408 has a diameter D21 which is larger than the diameter D20, but which is slightly smaller than the diameter D19 of the compression medium 386. The diameter D21 is also preferably slightly smaller than the diameter D17 of the tool body 340 such that the first end 400 of the internally threaded cone 388 can be inserted into the stop cavity 358 of the tool body 340. A second portion 412 of the outer wall 408 of the internally threaded cone 388 extends from the first portion 410 of the outer wall 408 to the second end 402 of the internally threaded cone 388. The second portion 412 of the outer wall 408 is tapered such that the outer wall 408 has a diameter D22 at the second end 402 of the internally threaded cone 388, which is larger than the diameter D21 at the first end 400 of the internally threaded cone 388. The diameter D22 is preferably commensurate with the diameter D18 of the compression medium 386. The second portion 412 of the outer wall 408 may also be provided with a plurality of ribs (not shown) extending therefrom. The internally threaded cone 388 is formed of a material which is harder than a material from which the compression medium 386 is formed, preferably the internally threaded cone 388 is formed of a material which is three times as strong as the material from which the compression medium 386 is formed. For instance, the compression medium 386 could be formed of zinc and the internally threaded cone 388 could be formed of lead, or the compression medium 386 could be formed of aluminum or plastic, while the internally threaded cone 388 is formed of steel.

The internally threaded cone 388 is inserted into the aperture 394 of the compression medium 396 by inserting the first end 400 of the internally threaded cone 388 into the aperture 394 at the second end 392 of the compression medium 396 until the second portion 412 of the outer wall 408 abuts against the second end 392 of the compression medium 386. The first end 400 of the internally threaded cone 388 is thus distanced from the first end 390 of the compression medium 386, as illustrated in FIG. 16.

Figure 17:
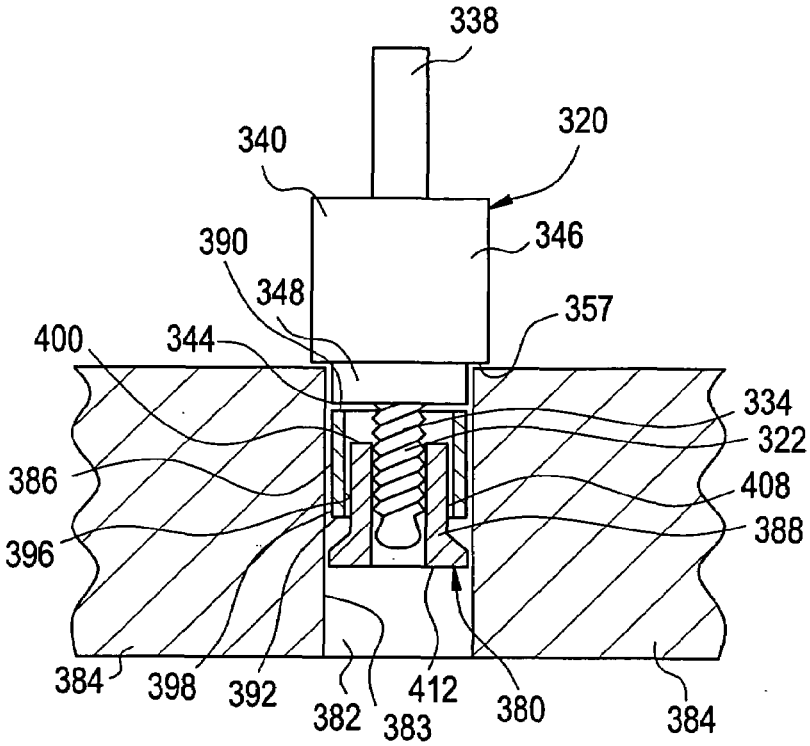

As illustrated in FIG. 17, the anchor 380 is connected to the setting tool 320 by threading the internally threaded cone 388 onto the third portion 334 of the tool shaft 322, either by hand or by triggering the drill (not shown), until the first end 390 of the compression medium 386 abuts against the second end 344 of the tool body 340.

The setting tool 320 is then aligned with the aperture 382 of the substrate 384 and is moved toward the aperture 382 of the substrate 384 in order to position the anchor 380 within the aperture 382 of the substrate 384. This movement is continued until the shoulder 357 of the tool body 340 is positioned against the substrate 384.

Figure 18:
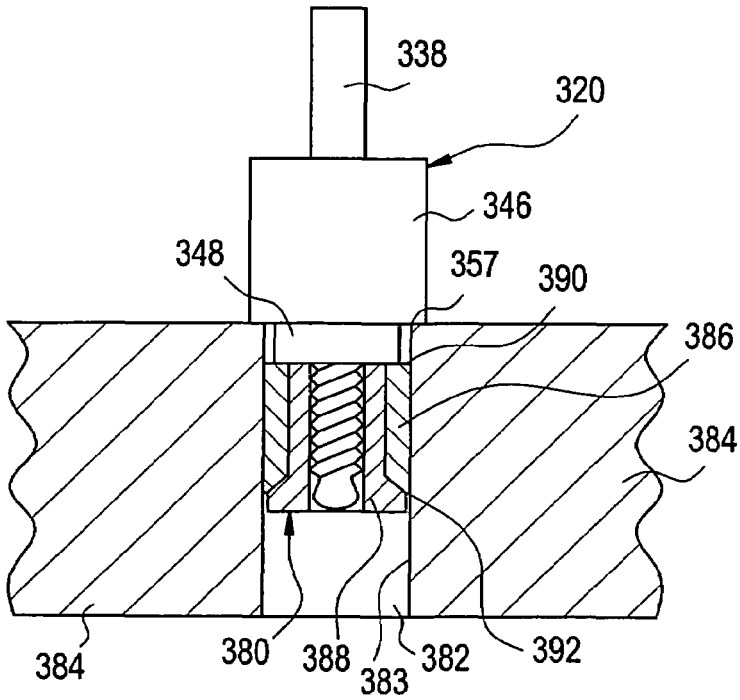

The operator then applies a slight pressure to the setting tool 320 in order to hold the setting tool 320 on the substrate 384 and to prevent rotation of the setting tool 320 on the substrate 384. The operator then actuates the drill (not shown) such that the tool shaft 322 is rotated. As the tool shaft 322 is rotated, and because the shoulder 357 of the tool body 340 is held against the substrate 384, the anchor 380 is drawn up by the tool shaft 322 and the setting process of the anchor 380 in the aperture 382 of the substrate 384 is begun, as illustrated in FIGS. 17 and 18.

During the setting process of the anchor 380, pressure is applied to the setting tool 320 and the tool shaft 322 is rotated, the internally threaded cone 388 of the anchor 380 is drawn into the compression medium 386. To prevent rotation of the compression medium 386 as the internally threaded cone 388 is drawn into the compression medium 386 by the tool shaft 322, either the compression medium 386 at its first end 390, or the tool body 340 at its second end 344, or both, is provided with a plurality of anti-rotation ribs (not shown). The second end 344 of the tool body 340 also applies a downward load on the compression medium 386, thus compressing the compression medium 386 and controlling the upward flow of the compression medium 386 in the aperture 382 of the substrate 384. Further, the plurality of ribs (not shown) on the second portion 412 of the outer wall 408 of the internally threaded cone 388 prevent rotation of the internally threaded cone 388 relative to the compression medium 386 as the internally threaded cone 388 is drawn into the compression medium 386.

As the internally threaded cone 388 is drawn into the compression medium 386, the second portion 412 thereof pushes against the inner wall 396 of the compression medium 386, such that the outer wall 398 of the compression medium 386, proximate to the second 392 thereof, exerts a controlled radial force against an aperture wall 383, which is defined by the aperture 382, of the substrate 384, and such that the compression medium 386 is deformed by the internally threaded cone 388. The pressure exerted on the compression medium 386 by the internally threaded cone 388 and the pressure exerted on the aperture wall 383 by the compression medium 386 function to lock the anchor 380 within the aperture 382 of the substrate 384.

As the second portion 412 of the internally threaded cone 388 is drawn into the compression medium 386, the first end 400 of the internally threaded cone 388 is drawn into the stop cavity 358 of the tool body 340. The external threading of the third portion 334 of the tool shaft 322 preferably extends above the stop cavity 358 to allow the internally threaded cone 388 to be pulled into the stop cavity 358. The stop cavity 358 is of a diameter D17, which is larger than the diameter D21 of the anchor 380, in order to allow for the first end 400 of the internally threaded cone 388 to be drawn into the stop cavity 358 and to allow for an alignment guide during the setting process. Once the first end 400 of the internally threaded cone 388 abuts against the shoulder 359 of the tool body 340, the internally threaded cone 388 has properly expanded the compression medium 386 to its optimum expansion against the aperture wall 383 of the substrate 384. The stop cavity 358 can be provided with a depth that is predetermined to ensure that once the first end 300 of the internally threaded cone 388 abuts against the shoulder 359, the internally threaded cone 388 has properly expanded the compression medium 386 to its optimum expansion against the aperture wall 383 of the substrate 384. The stop cavity 358 prevents overdrawing of the internally threaded cone 388 into the compression medium 386.

Once the anchor 380 is set in the aperture 382 of the substrate 384, the tool shaft 322 can be removed from the anchor 380 by switching the drill (not shown) into reverse until it is extracted from the anchor 380. Once the setting tool 320 is removed from the anchor 380, the operator can perform an additional visual check to ensure that the anchor 380 is properly set by making sure that the first end 400 of the internally threaded cone 388 is about the first end 390 of the compression medium 386.

Thus, the tool 320 does not require the anchor 380 to be of the bottom-setting type. Further, the tool 320 does not require a hammer strike to set the anchor 380. Securement of the anchor 380 to the aperture wall 383 are provided mainly at the second end 392 of the compression medium 386 to ensure that the anchor 380 has the proper holding value.

While preferred embodiments of the invention are shown and described, it is envisioned that those skilled in the art may devise various modifications without departing from the spirit and scope of the foregoing description and of the appended claims.

The invention is claimed as follows:

1. A tool for setting an assembled anchor within an aperture of a substrate, the aperture having a depth which is at least as long as a length of the assembled anchor, said tool comprising:

a shaft having a first end and a second end, said shaft being at least partially threaded proximate to said second end thereof;

means for rotating said shaft comprising an adaptor member connected to said first end of said shaft;

a body having a first end and a second end, said body having an aperture extending from said first end thereof to said second end thereof, said shaft being positioned within said aperture with said first end of said shaft being positioned within said aperture proximate to said first end of said body and with said second end of said shaft being positioned within said aperture and extending beyond said second end of said body such that the assembled anchor can be threadedly engaged with said shaft from said second end of said shaft, said adaptor member of said rotating means extending beyond said first end of said body such that said adaptor member is capable of being connected to a drill bit of a drill outside of said aperture of said body.

2. A tool for setting an assembled anchor within an aperture of a substrate, the aperture having a depth which is at least as long as a length of the assembled anchor, said tool comprising:

a shaft having a first end and a second end, said shaft being at least partially threaded proximate to said second end thereof;

means for rotating said shaft;

a body having a first end and a second end, said body having an aperture extending from said first end thereof to said second end thereof, said shaft being positioned within said aperture with said first end of said shaft being positioned within said aperture proximate to said first end of said body and with said second end of said shaft being positioned within said aperture and extending beyond said second end of said body such that the assembled anchor can be threadedly engaged with said shaft from said second end of said shaft; and a normally-expanded spring member positioned around said body proximate to said second end thereof.

3. A tool as defined in claim 2, further including means for preventing said spring member from expanding around said body.

4. A tool as defined in claim 3, wherein said body has an outer wall which is at least partially threaded proximate to said second end of said body.

5. A tool as defined in claim 4, wherein said preventing means comprises at least one nut member which is threadedly engaged with said outer wall of said body between said spring member and said first end of said body.

6. A tool as defined in claim 5, wherein said at least one nut includes a spring retainer nut which is threadedly engaged with said outer wall of said body between said spring member and said first end of said body, and a jam nut which is threadedly engaged with said outer wall of said body between said spring retainer nut and said first end of said body.

7. A tool as defined in claim 1, wherein said shaft has a first portion, a second portion, a third portion and a fourth portion, said first portion being provided at said first end of said shaft, said second portion extending from said first portion toward said second end of said shaft, said third portion extending from said second portion toward said second end of said shaft, said third portion being externally threaded, said fourth portion extending from said third portion to said second end of said shaft.

8. A tool as defined in claim 7, wherein said first portion of said shaft has a diameter which is larger than a diameter of said second portion of said shaft such that a shoulder is defined between said first and second portions of said shaft.

9. A tool for setting an assembled anchor within an aperture of a substrate, the aperture having a depth which is at least as long as a length of the assembled anchor, said tool comprising:

a shaft having a first end and a second end, said shaft being at least partially threaded proximate to said second end thereof, said shaft has a first portion, a second portion, a third portion and a fourth portion, said first portion being provided at said first end of said shaft, said second portion extending from said first portion toward said second end of said shaft, said third portion extending from said second portion toward said second end of said shaft, said third portion being externally threaded, said fourth portion extending from said third portion to said second end of said shaft;

means for rotating said shaft; and a body having a first end and a second end, said body having an aperture extending from said first end thereof to said second end thereof, said shaft being positioned within said aperture with said first end of said shaft being positioned within said aperture proximate said first end of said body and with said second end of said shaft being positioned within said aperture and extending beyond said second end of said body such that the assembled anchor can be threadedly engaged with said shaft from said second end of said shaft, said aperture has a first portion, a second portion, and a third portion, said first portion of said aperture extending from said first end of said body toward said second end of said body, said second portion of said aperture extending from said first portion of said aperture toward said second end of said body, said second portion of said aperture having a diameter which is smaller than a diameter of said first portion of said aperture such that a shoulder is defined between said first and second portions of said aperture, said third portion of said aperture extending from said second portion of said aperture to said second end of said body, said third portion of said aperture having a diameter which is larger than said diameter of said second portion of said aperture such that a shoulder is defined between said second and third portions of said aperture, said third portion of said aperture defining a stop cavity.

10. A tool as defined in claim 9, wherein said first portion of said shaft is positioned within said first portion of said aperture, said first portion of said shaft having a diameter which is smaller than said diameter of said first portion of said aperture and which is larger than said diameter of said second portion of said aperture.

11. A tool as defined in claim 10, wherein said second portion of said shaft is substantially positioned within said second portion of said aperture, said second portion of said shaft having a diameter which is slightly smaller than said diameter of said second portion of said aperture.

12. A tool as defined in claim 10, wherein said third portion of said shaft is partly positioned within said third portion of said aperture, said third portion of said shaft having a diameter which is smaller than said diameter of said third portion of said aperture.

13. A tool as defined in claim 12, wherein said diameter of said third portion of said aperture is sized to receive a portion of the assembled anchor upon operation of the tool such that the portion of the assembled anchor is capable of abutting against said shoulder defined between said second and third apertures.

14. A tool as defined in claim 10, further including means for separating said shoulder defined by said first and second portions of said shaft from said shoulder defined by said first and second portions of said aperture.

15. A tool as defined in claim 14, wherein said separating means includes a washer and a bearing, said washer being positioned around said second portion of said shaft and being positioned on said shoulder defined by said first and second portions of said aperture, said bearing being positioned around said second portion of said shaft and being positioned between said washer and said shoulder defined by said first and second portions of said shaft.

16. A tool as defined in claim 14, wherein said separating means includes a ball bearing, said ball bearing being positioned around said second portion of said shaft and being positioned on said shoulder defined by said first and second portions of said aperture.

17. A tool as defined in claim 10, further including means for sealing said first portion of said aperture at said first end of said body.

18. A tool as defined in claim 17, wherein said sealing means comprises a washer and a c-clamp, said first portion of said aperture defining a notch proximate to said first end of said body, said c-clamp being secured within said notch and being positioned around said rotating means, said washer being positioned against said c-clamp and being positioned around said rotating means.

19. A tool as defined in claim 1, wherein said rotating means engages said shaft such that the assembled anchor is drawn up said shaft a required distance to set the assembled anchor within the aperture of the substrate.

20. A tool as defined in claim 19, further including means for preventing the assembled anchor from being drawn up said shaft beyond said required distance.

21. A tool as defined in claim 20, wherein said preventing means comprises a body having a stop cavity defined therein defining a shoulder within said body, the assembled anchor being prevented from being drawn up said shaft when the assembled anchor contacts said shoulder.

22. A tool as defined in claim 20, further including means for identifying when the assembled anchor is set within the aperture of the substrate.

23. A tool for setting an assembled anchor within an aperture of a substrate, the aperture having a depth which is at least as long as a length of the assembled anchor, said tool comprising:

means for engaging the assembled anchor;

means for rotating said engaging means such that the assembled anchor is drawn up said engaging means a required distance to set the assembled anchor within the aperture of the substrate;

means for preventing the assembled anchor from being drawn up said engaging means beyond said required distance; and means for identifying when the assembled anchor is set within the aperture of the substrate, said identifying means comprises a normally-expanded spring member positioned around said preventing means, said spring member capable of being compressed such hat said spring member solids up, the assembled anchor being set when said spring member solids up.

24. A method of setting an assembled anchor in a substrate, said method comprising the steps of:

forming an aperture within said substrate which is at least as long as said anchor;

threading said assembled anchor onto a threaded shaft of said tool until said assembled anchor is against a tool face surface;

inserting said tool into said aperture of said substrate such that a portion of said tool is positioned against a surface of said substrate;

applying a pressure to said tool to prevent rotation of said tool on said surface of said substrate; and rotating said threaded shaft of said tool to draw said assembled anchor up said threaded shaft of said tool toward a body of said tool to set said assembled anchor within said aperture of said substrate, wherein during generally said entire rotation of said threaded shaft, said portion of said tool remains positioned against said surface of said substrate.

25. A method of setting an assembled anchor in a substrate, said method comprising the steps of:

forming an aperture within said substrate which is at least as long as said anchor;

threading said assembled anchor onto a threaded shaft of said tool until said assembled anchor is against a tool face surface;

inserting said tool into said aperture of said substrate such that a portion of said tool is positioned against a surface of said substrate;

applying a pressure to said tool to prevent rotation of said tool on said surface of said substrate;

rotating a spring along an outwardly threaded body of said tool until an end of said spring is flush with said tool face surface;

tightening a jam nut against a spring retainer nut to lock said spring in position; and inserting said tool into said aperture of said substrate such that said spring is against a surface of said substrate, said spring being said portion of said tool which is positioned against said surface of said substrate.

26. A method as defined in claim 24, further including the step of:

drawing said assembled anchor up said threaded shaft of said tool toward said body of said tool to set said assembled anchor within said aperture of said substrate until said assembled anchor contacts said body of said tool.

27. A method as defined in claim 26, further including the step of:

removing said threaded shaft of said tool from said assembled anchor after said assembled anchor contacts said body of said tool.

* * * * *

UNITED STATES PATENT AND TRADEMARK OFFICE

CERTIFICATE OF CORRECTION

PATENT NO. : 7,065,855 B2
APPLICATION NO. : 10/374592
DATED : June 27, 2006
INVENTOR(S) : Michael Janusz It is certified that error appears in the above-identified patent and that said Letters Patent is hereby corrected as shown below:

Column 10, Line 53 “5 first” should be -- first --

Column 17, Line 3 “hat” should be -- that --

Column 17, LIne 21 “wherein” should be -- whereby --

Column 18, Lines 5-6 “substrate; rotating” should be

-- rotating said threaded shaft of said tool to draw said assembled anchor up said threaded shaft of said tool toward a body of said tool to set said assembled anchor within said aperture of said substrate; --

Signed and Sealed this

Seventeenth Day of October, 2006

JON W. DUDAS
*Director of the United States Patent and Trademark Office*